United States Patent [19]

Kimura

[11] Patent Number: 4,667,445

[45] Date of Patent: May 26, 1987

[54] ROTARY GRINDING MACHINE

[75] Inventor: Sosaku Kimura, Tokyo, Japan

[73] Assignee: Citizen Watch Co., Ltd., Tokyo, Japan

[21] Appl. No.: 756,239

[22] Filed: Jul. 18, 1985

[30] Foreign Application Priority Data

Jul. 28, 1984 [JP] Japan ..... 59-158330
Jul. 28, 1984 [JP] Japan ..... 59-158332

[51] Int. Cl.[4] ..... B24B 7/04

[52] U.S. Cl. ..... 51/131.1; 51/132; 51/165.75; 51/237 R

[58] Field of Search ..... 51/165.9, 165.91, 165.92, 51/131.1, 131.2, 131.3, 133, 131.4, 132, 165.75, 237 R

[56] References Cited

U.S. PATENT DOCUMENTS 431,163 7/1890 Gould ..... 51/131.1 X
4,575,969 3/1986 Klingel et al. ..... 51/131.1

FOREIGN PATENT DOCUMENTS 1029699 5/1958 Fed. Rep. of Germany ..... 51/131.3
1422908 1/1976 United Kingdom .
812539 3/1981 U.S.S.R. ..... 51/133

*Primary Examiner*—Robert P. Olszewski
*Attorney, Agent, or Firm*—Finnegan, Henderson, Farabow, Garrett & Dunner

[57] ABSTRACT

A rotary grinding machine comprising a grinding wheel supported by a column on a bed, a work table rotatably supported on the bed and carrying thereon a workpiece to be ground, a fluid passage holder located in a circumferential groove formed in the work table and having fluid pressure pockets connected to a fluid pressure source. The work table is inclined with respect to the grinding wheel when the pressurized fluid is selectively fed to the pressure pockets in a predetermined direction. The control method of the grinding machine is also disclosed.

7 Claims, 11 Drawing Figures

ROTARY GRINDING MACHINE

BACKGROUND OF THE INVENTION

1. Field of the Invention

The present invention relates to a rotary grinding machine and a fine adjustment of the depth of cut thereof. More particularly, the present invention relates to a rotary grinding machine in which a work table carrying a workpiece to be ground rotates relative to a grinding wheel.

2. Description of the Related Art

In a typical rotary grinding machine, there is a difference in peripheral speed between a central portion and a circumferential portion of the work table. Because of this difference in the peripheral speed, the surface of the workpiece to be ground is not always even after the grinding operation is finished. Namely, a close look at the surface of the workpiece which has been ground will reveal that the portion of the surface located near the center of the workpiece has been cut deeper than the portion of the surface located adjacent to the periphery of the workpiece. To eliminate this unevenness of the ground surface of the workpiece, usually a predetermined relative inclination is provided between the surface of the workpiece and the surface of the grinding wheel, in accordance with the scope of the unevenness. This inclination depends on the machinability, size, or cutting conditions of the workpiece, and accordingly, must be adjusted to match those conditions. The adjustment of the inclination is usually carried out by changing the inclination angle of the grinding wheel with respect to the workpiece.

Adjustment of the inclination angle of the grinding wheel per se is usually effected by the use of adjusting washers or plates which can be located at one side of the bottom surface of a column holding the grinding wheel, so that the column is inclined. The angle of inclination depends on the number of the adjusting washers used. However, in this conventional adjustment, it is very difficult to finely adjust the inclination angle, since the adjustment of the inclination angle is usually in the order of microns. In addition, according to the conventional method of adjusting the inclination of the grinding wheel, another disadvantage arises in that the column, which is secured to a base (bed), tends suffer from an irregular and unbalanced securing load from fixtures, such as bolts, used to secure the column to the base, since the adjusting washers are provided between the bottom of the column and the base to incline the column, and accordingly, the grinding wheel, as mentioned before. This unbalance in the securing load results in a lack of stability of the column, and accordingly, the grinding wheel, and in a lessening of the required strength of the connection between the column and the base.

Furthermore, it is very difficult to finely adjust the depth of cut of the grinding wheel in the order of microns by the conventional method, since this fine adjustment can be made only by adjusting the height of the grinding wheel by moving it up and down.

SUMMARY OF THE INVENTION

The primary object of the present invention is to provide a rotary grinding machine in which a fine adjustment of the relative inclination between the grinding wheel and the workpiece can be easily made, even in the order of microns.

Another object of the present invention is to provide a rotary grinding machine which can obtain a precise evenness of the ground surface of the workpiece.

Still another object of the present invention is to provide a method of fine adjustment of the depth of cut in a rotary grinding machine.

Still another object of the present invention is to provide a method of easy and fine adjustment of the depth of cut in which the surface of the workpiece can be uniformly ground by a predetermined amount of cut.

To achieve the objects mentioned above, according to the present invention, there is provided a rotary grinding machine comprising a grinding wheel supported by a column on a bed, a work table rotatably supported on the bed and carrying thereon at least one workpiece to be ground, and fluid pressure means between the bed and the work table for inclining the work table with respect to the grinding wheel.

According to another aspect of the invention, there is provided a method of control of a rotary grinding machine including a grinding wheel supported by a column on a bed, a work table rotatably supported on the bed and carrying thereon at least one workpiece to be ground, wherein the control method comprises inclining the work table with respect to the grinding wheel in the course of a grinding operation.

Inclining is effected by using a fluid pressure acting on the work table.

A displacement of the work table is carried out in such a manner that the work table is moved close to and away from the grinding wheel, to make fine adjustments to the depth of cut of the grinding wheel.

BRIEF DESCRIPTION OF THE DRAWINGS

The present invention will be discussed below in detail with reference to the accompanying drawings, in which.

DESCRIPTION OF THE PREFERRED EMBODIMENTS

Figure 1:
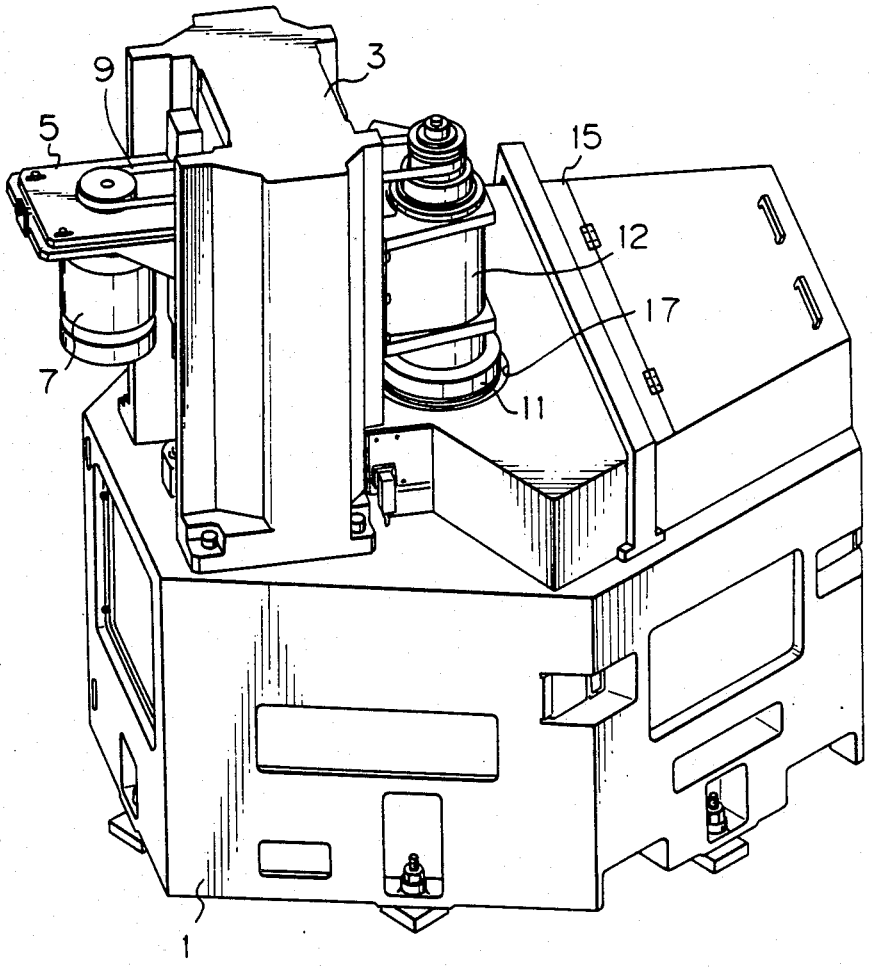
FIG. 1 is a perspective view of a rotary grinding machine according to the present invention.

FIG. 1 generally shows a rotary grinding machine of the present invention, which, per se, is similar to a conventional rotary grinding machine. In the Figure, an upstanding column 3 is integrally provided on a bed (base) 1, the column 3 slidably supports an elevation holder 5. Upward and downward movement of the elevation holder 5 is effected by, for example, a known so-called feed screw shaft (not shown) provided in the column 3. The elevation holder 5 supports a drive motor 7 for driving a grinding wheel 11 supported by a wheel head 12. A spindle 14 (FIG. 2) of the grinding wheel 11 is operatively connected to the drive motor 7 by means of a belt 9, so that the grinding wheel 11 can be rotated by the drive motor 7.

Figure 2:
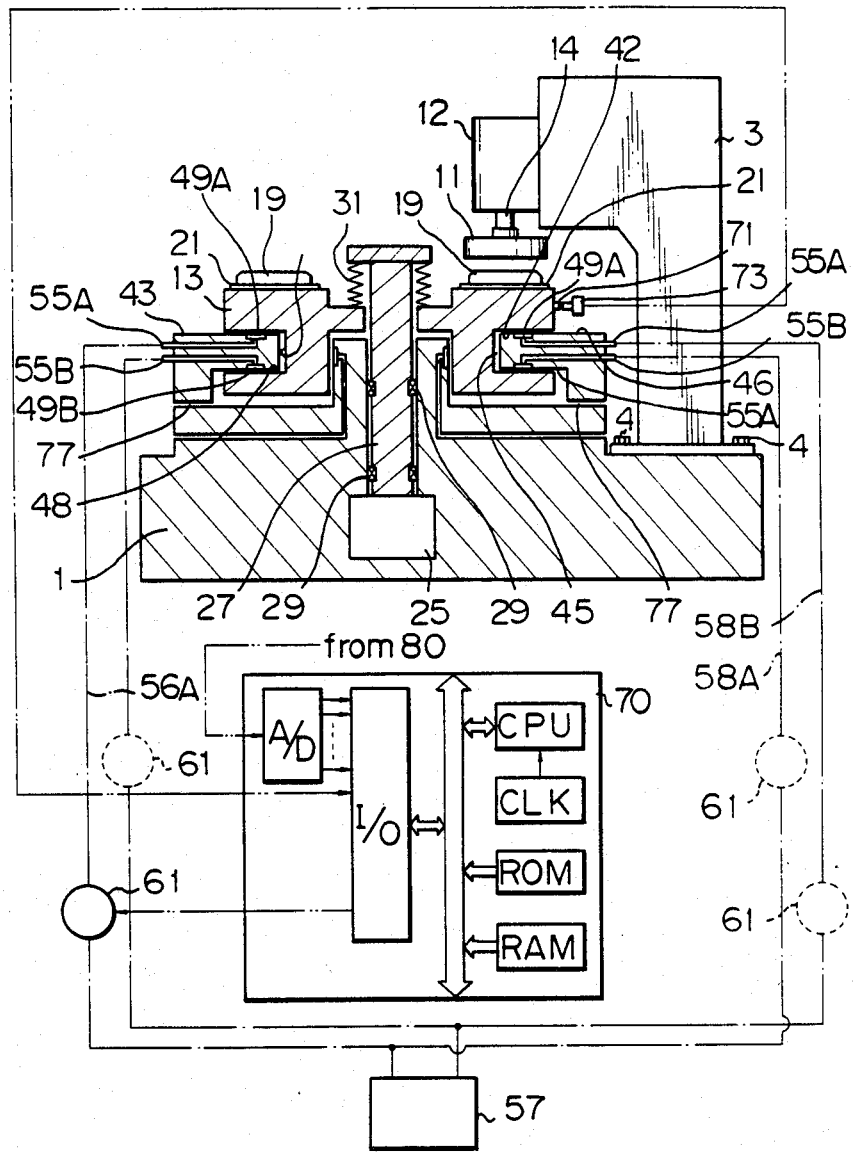
FIG. 2 is a schematic sectional view of a rotary grinding machine according to the present invention.
Figure 5:
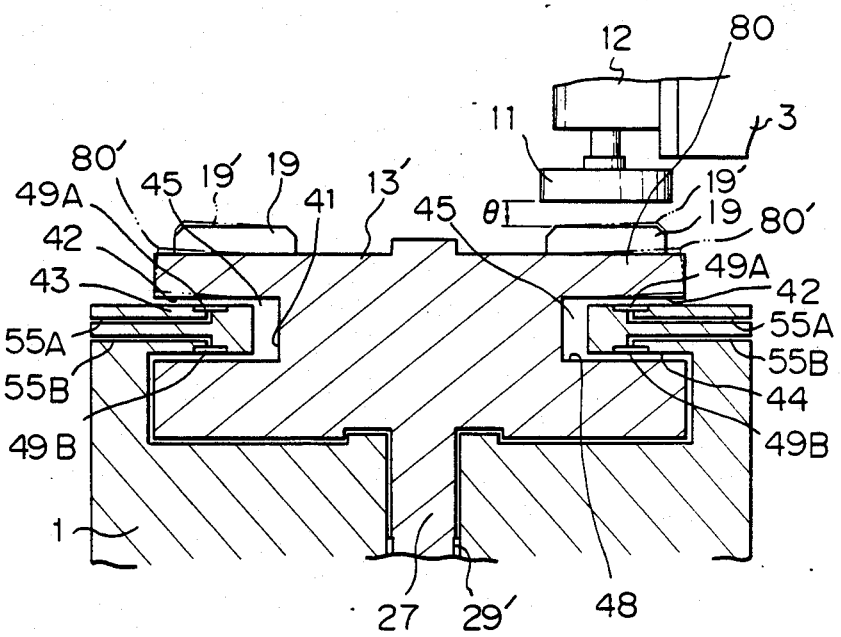
FIG. 5 is a view similar to FIG. 4 of another embodiment of the present invention.

As shown in FIG. 2, a work table 13 is located in a housing 15 having an opening 17 through which the grinding wheel 11 is inserted in the housing 15 to grind a workpiece 19 immovably held by a magnetic or vacuum chuck device 21 on the work table 13. The work table 13 is rotated by a drive motor 25 provided in the bed 1. The drive motor 25 has a shaft 27 connected thereto rotatably supported in the bed 1 by means of, for example, angular ball bearings 29. The shaft 27 is connected to the work table 13 by a spring 31 provided between the work table 13 and the upper end of the shaft 27, so that the work table 13 can rotate together with the shaft 27. The spring 31 allows the shaft 27 to move slightly in the axial direction thereof and prevents possible oscillation or vibration of the motor 25 from being directly transmitted to the work table 13. Alternatively, it is also possible to provide a work table 13' in which the shaft 27 is integral therewith, as shown in FIG. 5, so that the work table 13' can be directly rotated by the motor 25. In this alternative, the shaft 27 can be rotatably supported by thrust bearings 29' or conventional metal sleeves (not shown) which enable the shaft 27 to move slightly in the axial direction.

Figure 3:
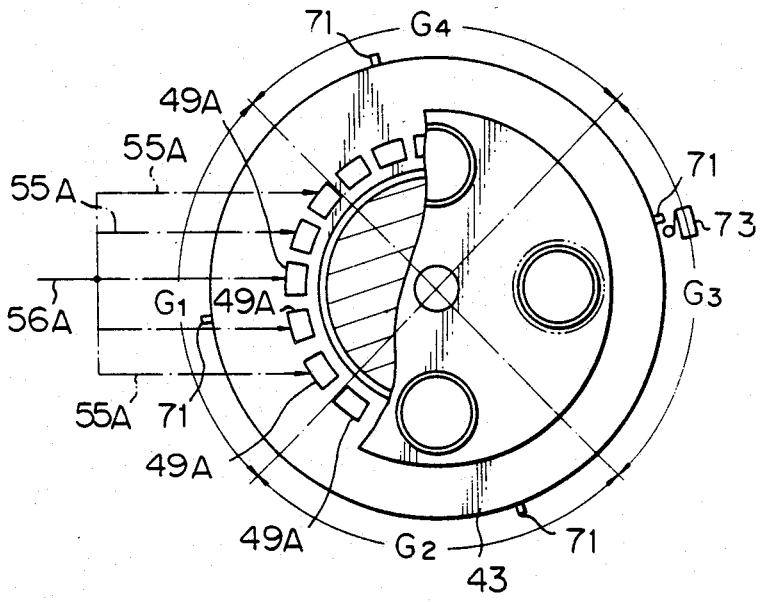
FIG. 3 is a partially sectioned plan view of a work table of a rotary grinding machine shown in FIGS. 1 and 2.

The workpieces 19 are usually circumferentially arranged on the work table 13 at an equiangular distance, for example, 90°, as shown in FIG. 3. The workpiece 19 are successively fed to a grinding position in which one workpiece 19 is located directly below the grinding wheel 11, in accordance with the rotational movement of the work table 13. The work table 13 usually rotates at a very low speed. For this purpose, known reduction gears (not shown) are provided between the drive motor 25 and the shaft 27 to reduce the rotational speed of the shaft 27, and accordingly, the work table 13.

In the rotary grinding machine as mentioned above, because of the difference in the peripheral speed of the central portion and the circumferential portion of the work table 13, the circumferential portion of the workpiece surface is not always completely ground to a predetermined depth of cut in comparison with the central portion of the workpiece surface. This is because the circumferential surface portion of the workpiece is cut deeper in comparison with the central surface portion of the workpiece, due to the difference in the peripheral speed of the work table. This results in the formation of an unevenly ground surface of the workpiece.

To eliminate such unevenness, as mentioned before, a relative inclination angle $\theta$ (FIG. 4) is usually provided between the surface of the grinding wheel and the surface of the workpiece opposed to the grinding wheel. The provision of the inclination angle $\theta$ makes it possible to eliminate any convexity of the ground surface of the workpiece. In the prior art, in order to provide the inclination angle $\theta$, shims, such as adjusting plates or wedges (not shown), are inserted between the bottom of the column 3 and the opposed surface of the bed 1, but only at one side, as mentioned before. The direction of inclination is determined in accordance with the convex profile of the ground surface of the workpiece. However, in this adjustment of the inclination angle $\theta$, it is very difficult or next to impossible to make a fine adjustment in the order of microns by using adjusting shims, as mentioned hereinbefore. Furthermore, since the bolts 4 (FIG. 2) adapted to secure the column 3 to the base 1 are subject to an unbalanced load due to the shims, it is also difficult to ensure the necessary stable connection strength between the column and the base.

Figure 10A:
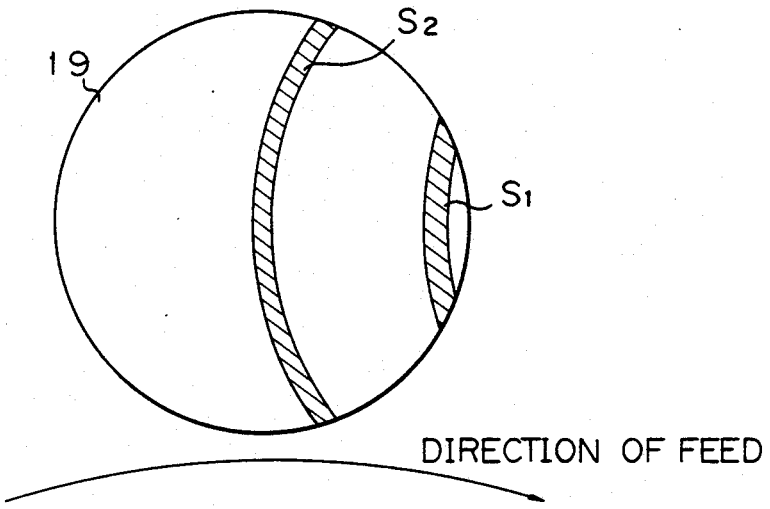
Figure 10B:
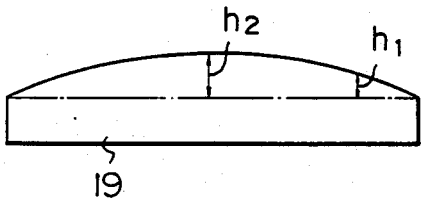
Fig. 10B PRIOR ART

Note, in this connection, careful attention must be paid to the difference in the grinding area of the grinding wheel relative to the surface of the workpiece between the center portion and the circumferential portion of the workpiece. This difference in the grinding area results in a difference in the cutting resistance, i.e., the grinding resistance. This is explained by FIG. 10A, in which the area of the central portion S2 of the workpiece surface is larger than the area of the circumferential portion S1. Due to the difference in the cutting resistance, the ground surface of the workpiece presents a convex profile, as shown in FIG. 10B, in which the central area has a larger convex portion remaining after grinding, represented by the height h2, in comparison with the remaining portion in the peripheral area, represented by h1. The difference in the heights h1 and h2 is derived from the fact that the larger the grinding surface area S of the workpiece, the larger the cutting resistance. Note, the undesirable convex profile is exaggerated in FIG. 10B; in actual products, the heights h1 and h2 are both in the order of microns. According to the present invention, such remaining undesirable portion also can be eliminated.

In the present invention, the work table 13 has a circumferential annular groove 41 in which an annular holding portion 43 formed integral with the base 1 is located. Between the holding portion 43 and the groove 41 a circumferential space 45 surrounding the holding portion 43 is provided. Normally, the work table 13 is held on the upper surface 46 of the holding portion 43 by the dead weight of the work table 13. Namely, there is no gap between the upper surface 46 of the holding portion and the upper surface 42 of the groove 41 when the work table 13 is held on the holding portion 43 in an inoperative position in which no fluid pressure is applied in the space 45, which will be discussed in detail hereinafter. The holding portion 43 has a plurality of static pressure pockets 49A, 49B opening into the space (pressure chamber) 45 and arranged on the upper and lower surfaces 46 and 48 of the holding portion 43, respectively along imaginary circles, preferably at an equiangular distance in the circumferential direction of the holding portion 43. The group of upper pockets 49A and the group of lower pockets 49B are in a symmetrical arrangement with each other. The pockets 49A and 49B are hydraulically or pneumatically connected to a fluid pressure source 57, such as an oil pump or an air pump, by means of respective connecting pipes 55A and 55B. Pressurized fluid, such as oil or air is fed into the space 45 through the respective pockets 49A and 49B from the fluid source 57 by means of the respective pipes 55A and 55B.

Preferably, pressure control devices 61 are provided in the respective connecting pipes 55A and 55B, such as pressure reducing valves, or known servovalves to independently control the pressure in the associated pipes 55A and 55B.

The pressure in the pockets 49A and 49B can be independently adjusted by the respective pressure control devices 61, such as servovalves. Alternatively, it is also possible to divide the upper and lower pockets into several groups of pockets, for example, four groups, as shown in FIG. 3, respectively. Namely, in the illustrated embodiment, the upper pockets 49A are divided into four groups $G_1 \sim G_4$, each having, for example, five pockets, respectively. That is, the circumference of the upper surface of the holding portion 43 is divided into four $G_1 \sim G_4$ spaced 90 degrees apart. Pockets in the same group are connected to the common pressure control device 61, and have the same fluid pressure. Namely, control of the pressure can be effected group by group. This is also applicable to the lower pockets 49B. Namely, the lower pockets 49B are divided into four groups of pockets, each having five pockets, and each group is connected to a common pressure control device 61.

Figure 4:
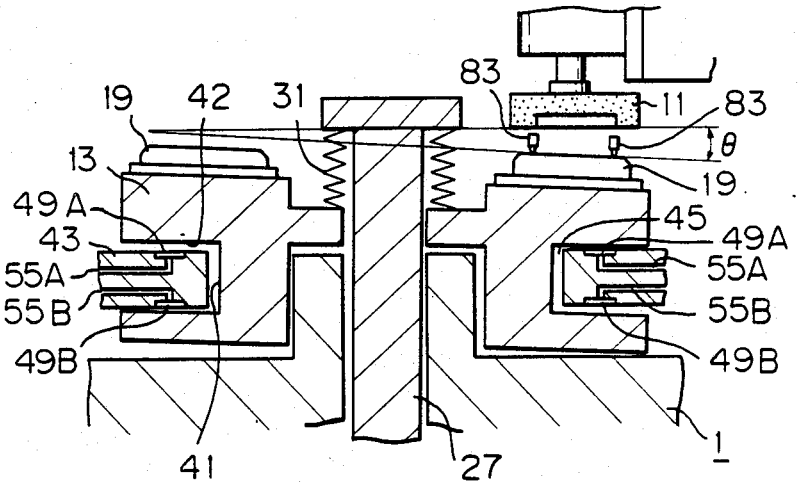
FIG. 4 is an enlarged view of a part of FIG. 2 showing an inclined position of a workpiece.

To provide the inclination angle $\theta$ between the opposed surfaces of the grinding wheel 11 and the workpiece, according to the present invention, the work table 13 is inclined at a predetermined inclination angle and in the predetermined direction, with respect to the bottom surface of the grinding wheel 11, which is, for example, in the form of a so-called cup wheel, as shown in FIG. 4. To obtain the necessary inclination of the work table, the pressure of the pressurized fluid fed to the static pressure pockets 49A and 49B is controlled by the pressure control devices 61. In the simplest control, for example, only one servovalve 61 which is, for example, marketed by MOOG Inc. in USA and is known as single stage bifurcated servovalve, is provided in a common connecting pipe 56A for the group G1 which connects the connecting pipes 55A of the group G1 to the pressure source 57. Namely, by increasing only the pressure in the static pressure pockets of the group G1 in comparison with the static pressure pockets in the other groups G2, G3 and G4, by means of the servovalve 61, the work table 13 can be inclined as shown in FIG. 4. That is, the portion of the upper surface 42 of the groove 41 opposed to the pocket 49A of the group G1 is raised by the highly pressurized fluid fed from the pockets of the group G1 into the space 41, so that the work table 13 is entirely inclined with respect to the surface of the grinding wheel. It will be easily understood that the inclination depends mainly on the pressure difference between the group G1 and the group G3 opposite to the group G1. On the contrary, if the pressure in the group G1 is decreased in comparison with the other groups, the inclination angle is a negative value, i.e., the work table is inclined in the opposite direction to the foregoing. This negative inclination angle $\theta$ is used depending on the shape, material, machinability, etc., of the workpiece 19.

If all the common connecting pipes 56A, 56B, 58A, and 58B for the respective groups G1 to G4 have the servovalves 61 therein, the inclination angle and the inclination direction can be controlled by controlling the pressure of the fluid fed to the static pressure pockets of the respective groups by means of the servovalves 61, independently from each other.

Alternatively, it is also possible to control the inclination in such a way that highly pressurized fluid having the same pressure is fed both to the pockets in the group G1 and the pockets in the group on the lower surface 44 of the holding portion 43 and in symmetrical arrangement to the group G1 on the upper surface 46 of the holding portion 43. Namely, the work table 13 is subject to an upward force which tends to move the work table in the upward direction at the left side in FIG. 2, and a downward force which tends to move the work table in the downward direction at the right side in FIG. 2, so that the work table is subject to a couple (force) on the opposite sides thereof, resulting in an easy inclination of the work table with a small pressure difference.

As can be understood from the above, according to the present invention, the work table can be easily inclined by the pressure difference created by the static pressure pockets 49A and 49B.

Figure 9:
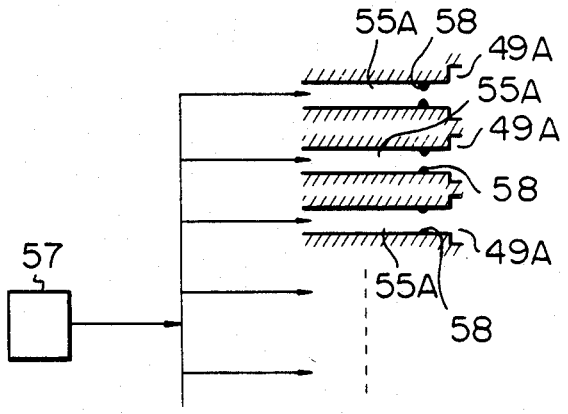
FIG. 9 is a schematic view of a variant of static pressure pockets which have restrictions in connection passages; and, FIGS. 10A and 10B are a plan view and side view, respectively, showing irregularities in the evenness of a surface of a workpiece obtained by the prior art.

The pressure difference can be also utilized to make a fine adjustment of the depth of cut which is usually and mainly effected by the upward and downward movement of the wheel head 12 having the grinding wheel 11, in the present invention. Namely, when the work table 13 is inclined in the direction in which the workpiece 19 occupying the working position directly below the grinding wheel 11 is lowered, as shown in FIG. 4, the depth of cut is slightly decreased, and vice versa. As mentioned before, the movement of the work table 13 by the inclination thereof due to the pressure differences between the upper and lower static pressure pockets is in the order of microns, and accordingly, the inclination of the work table 13 causes very slight upward or downward displacement. Furthermore, it is also possible to provide different restrictions 58 in the respective connection pipes 55A and 55B to control the pressure therein, as shown in FIG. 9. The different pressure ensures the creation of a pressure difference between the static pressure pockets. The sizes of the restrictions can be determined in accordance with the direction and the value of the inclination desired. The provision of the unvariable restrictions 58 are acceptable, particularly when the undesirable remaining convex portion (FIG. 10B) of the ground surface of the workpiece is not largely varied.

Figure 7:
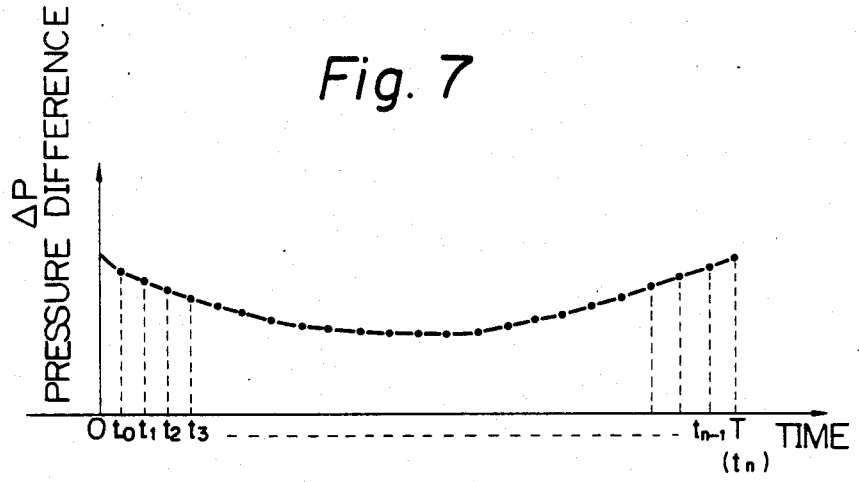
FIG. 7 is a diagram of an example of a map showing the variation of the pressure difference every sampling time in accordance with a profile of a ground surface of a test piece.

As mentioned before, the workpiece usually presents a generally convex profile of the ground surface due to the difference in the cutting resistance. In view of this convex profile, to obtain an evenly ground surface of the workpiece, it is necessary to provide an inclination of the surface of the workpiece to be ground so as to cancel that convexity. Namely, the inclination angle should be varied in accordance with the movement of the workpiece, as shown in FIG. 7. In FIG. 7, the inclination angle varies along the concave curve which compensates for the convex profile of the surface of the workpiece.

FIG. 7 shows a map of an example of a pressure difference curve with respect to time. Namely, how the pressure difference between the upper static pressure pocket 49A in the group G1 on the upper surface 46 of the holding portion 43 and the lower static pockets 49B in the corresponding group on the opposite lower surface 44 of the holding portion 43 can be varied, can be determined in accordance with the map shown in FIG. 7. The map can be made in advance by test grinding a test piece and can be stored in a control unit (computer unit) 70. Namely, a test piece the same as the workpieces to be ground is ground to measure the outer profile, usually a convex profile, of the ground surface of the workpiece, after the grinding wheel is set in the wheel head 12. By the test grinding, it can be assumed that workpieces the same as the test piece would present the same profile of the ground surface, because grinding is effected under exactly the same conditions. When the outer profile of the ground surface of the test piece is known, for example, as shown in FIG. 12B, the pressure difference curve can be obtained in advance so as to eliminate the convex profile.

The table below shows the values of the pressure differences at a sampling time, for example, 1 sec. Namely, the pressure differences are controlled every one second ($t_0$, $t_1$, $t_2$ . . . , $t_{n-1}$, $t_n$).

| Time (t) | Pressure Difference ($\Delta P$) |
|---|---|
| $t_0$ | $\Delta P_0$ |
| $t_1$ | $\Delta P_1$ |
| $t_2$ | $\Delta P_2$ |
| . | . |
| . | . |
| . | . |
| $t_{n-1}$ | $\Delta P_{n-1}$ |
| $t_n$ | $\Delta P_n$ |

The pressure differences are, for example, given as differences $\Delta P$ from a reference pressure, which is, for example, identical to the discharge pressure of the pressure source 57. The sampling time can be determined in accordance with the rotational speed of the work table 13 or the size of the workpieces. Preferably, the work table 13 has on its periphery projections 71 which can be detected by a detector 73, such as microswitch. The projection 71 represent the starting position of the grinding operation of the workpieces 19 by the grinding wheel 11. Namely, the detector 73 comes into contact with the projections 71 every time the workpieces 19 successively come to a grinding position directly below the grinding wheel 11, to detect the commencement of grinding. The detection signal of the detector 73 is sent to the control unit 70. Consequently, the control unit 70 starts to control the pressure difference in accordance with the map shown in FIG. 7.

Figure 8:
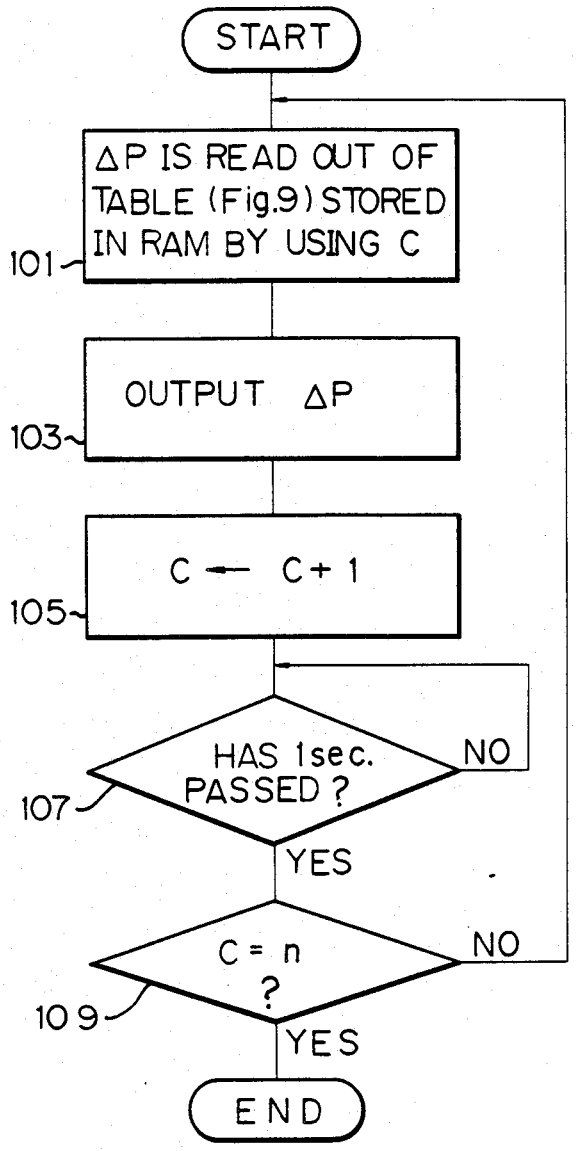
FIG. 8 is a flow chart showing an example of the control of a control unit shown in FIG. 2.

The total time To in FIG. 7 and in the table mentioned above corresponds to the time from the commencement to the completion of the grinding operation for one workpiece by the grinding wheel. The control unit 70 operates as follows (FIG. 8).

The pressure differences $\Delta P$ are read out of the map or table stored in the RAM by using the values of a counter C in the RAM at step 101. The pressure difference $\Delta P_0$ is then output and transmitted to the servovalve 61 (FIG. 2), at step 103. The servovalve 61 operates to control the pressure in the static pressure pockets 49A in the group G1, namely, to increase the pressure difference by $\Delta P_0$ to incline the work table 13. Then, the counter C is incremented by +1 at step 105. Then, at step 107, it is determined whether or not 1 sec. has passed. If 1 sec. has not passed, the control remains at step 107. If 1 sec. has passed, it is determined at step 109 whether or not the counter C is equal to N. If the determination is affirmative, the operation ends. If the counter C is not equal to N, the operation is returned to step 101. The same operation as mentioned above is then repeated until the counter C is equal to N, i.e., until the sampling time reaches the time To ($t_n$).

Thus, the pressure difference varies in accordance with the curve, as shown in FIG. 7, so that the inclination angle $\theta$ of the work table relative to the grinding wheel varies accordingly. This results in the cancellation of the undesirable convex profile of the workpiece surface which would otherwise occur. The map shown in FIG. 8 varies, of course, depending on the profile of the surface of the test piece determined by the test grinding and stored in the control unit 70. Generally speaking, the curve of the pressure difference represented by the map has a shape that compensates for the profile of the ground surface of the workpiece to cancel the same. It will be understood that, when the pressure difference is zero, i.e., there is no pressure difference between the upper side and lower side of the holding portion 43, which means there is no inclination of the work table, the outer profile of the workpiece is considered even.

When the servovalves 61 are provided in the respective common connection pipes 56A, 56B, 58A and 58B, the pressure differences $\Delta P$ are output and transmitted to the respective servovalves 61 to control the inclination of the work table 13 in accordance with a predetermined map stored in the control unit 70.

The fluid fed into the space 45 through the static pressure pockets is partially discharged through discharging passages 77 provided in the bed 1 and partially discharged through the upper surface 46 of the holding portion 43.

FIG. 5 shows another embodiments of the invention. In FIG. 5, the work table 13 has an upper thin-walled portion 80 which lies above the holding portion 43. The thickness of the thin walled portion 80 is such that when the high pressure acts on the annular upper surface 42 of the groove 41, the latter is deformed or deflected upward, as shown in FIG. 5, so that the thin walled portion 80 presents a concave profile of an upper surface as shown by an imaginary line 80' in FIG. 5. As a result of this deformation of the thin walled portion 80, the workpieces 19 are inclined at predetermined angle $\theta$. In the embodiment illustrated in FIG. 5, the groove 41 has a larger depth in the axial direction, to increase the thin wall effect, in comparison with the embodiment shown in FIG. 1. In this embodiment, in order to deform the thin walled portion 80 as mentioned above, it is possible to feed the fluid having the same pressure to both the upper side and lower side of the holding portion 43 through the static pressure pockets 49A and 49B. Namely, when the fluid of the same pressure acts on the lower surface 48 and the upper surface 42 of the groove 41, the thin walled portion 80 deforms but the portion of the work table that defines the lower surface 48 of the groove 41 does not deform, since it has a large thickness. When there is a pressure difference between the upper side and lower side of the holding portion 43, namely, when the pressure on the upper side of the holding portion is higher than that on the lower side thereof, the thin walled portion 80 deforms after the work table 13 raised to an upper limit position in which the lower surface 48 of the groove comes into contact with the lower surface 44 of the holding portion 43.

Also, in the embodiment shown in FIG. 5, a fine adjustment of the depth of cut can be effected by providing a pressure difference between the upper side and the lower side of the holding portion 43, thereby causing a slight displacement of the work table 13', similar to the first embodiment. In the embodiment in FIG. 5, since the work table 13 is integral with the shaft 27, the axial displacement of the work table can be absorbed by the bearings 29'.

Figure 6:
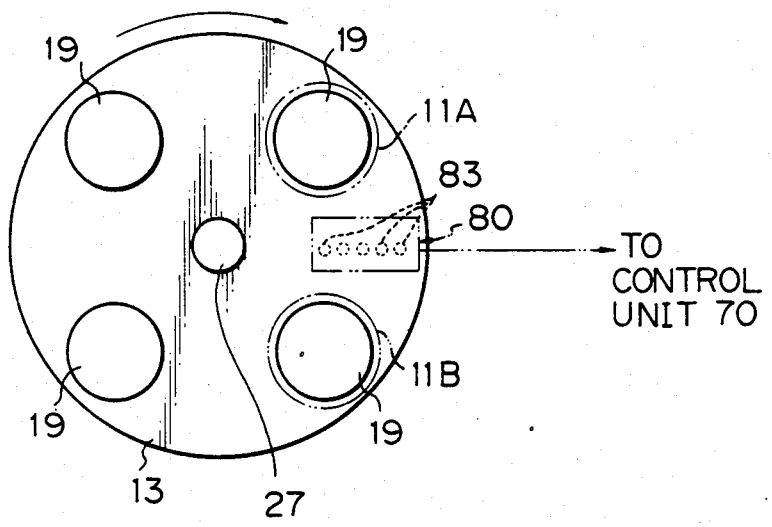
FIG. 6 is a schematic plan view of a work table according to still another embodiment of the present invention.

FIG. 6 shows still another embodiment of the invention, in which the grinding machine has two working stations, i.e., two independent grinding wheels 11A and llB, supported by the respective wheel heads similar to the wheel head 12 in FIG. 2, so as to rotate and move up and down. This kind of grinding machine is known as a two spindle type of rotary grinding machine. The first grinding wheel llA is used for rough grinding, and the second grinding wheel llB for finishing grinding. The fine adjustment of the inclination of the work table may not be necessary in the course of the rough grinding and can be effected only in the course of the finishing grinding. The numeral 80 in FIG. 6 designates a detector which detects the surface profile of the test piece and which is, for example, composed of known capacitance pick-up meters 83 (FIG. 6). The meters 83 are, for example, arranged along a line across the diameter of the surface of the work piece, at a predetermined distance. The capacitance pick-up meters 83 detect the surface profile of the ground surface of the test piece and output detection signals (e.g. voltage signals). The detection signals are transmitted to the control unit 70 where the control unit subjects the output signal of the detector 80 to A/D conversion and fetches the converted data. The map shown in FIG. 8 can be made in accordance with this data. The present invention is not directed to how the map can be prepared in accordance with the data, and accordingly, a detailed description of the preparation of the map is dispensed with. In the present invention, the map is stored in advance in the control unit 70.

As can be seen from the aforementioned, according to the present invention, a flat finishing surface of the workpiece can be obtained by controlling the static pressure acting on the work table in two directions, one for moving the work table upward and the other for moving the same downward. Namely, according to the present invention, the work table can be inclined at a predetermined inclination angle by control of the pressure so as to cancel the undesirable profile of the ground surface of a workpiece, as previously known. According to the present invention, it is also possible to obtain an optional desired profile of the ground surface of a workpiece other than flat by controlling the fluid pressure acting on the work table. Furthermore, according to the present invention, a fine adjustment of the depth of cut in a grinding operation can be achieved by controlling the fluid pressure acting on the work table.

I claim:

1. A rotary grinding machine comprising a grinding wheel which is supported by a column on a bed, a work table which is rotatably supported on the bed and has an annular groove and which carries thereon at least one workpiece to be ground, and fluid pressure means for inclining the work table with respect to the grinding wheel, said fluid pressure means comprising fluid pressure pockets opening into said annular groove.

2. The rotary grinding machine of claim 1, wherein said fluid pressure means includes passage means for feeding pressurized fluid to said fluid pressure pockets.

3. The rotary grinding machine of claim 2 wherein said passage means are located in the annular groove of said work table and define pressure chambers between it and said work table in said annular groove.

4. The rotary grinding machine of claim 1, including valve means for controlling the pressure of the fluid to be fed to said fluid pressure pockets.

5. The rotary grinding machine of claim 4, including means for controlling the operation of the valve means in accordance with a predetermined inclination of the work table.

6. The rotary grinding machine of claim 3, wherein said work table has a thin walled portion which defines said annular groove and which can be deformed when pressurized fluid acts on the thin walled portion.

7. The rotary grinding machine of claim 1, further comprising an additional grinding wheel.

8. A rotary grinding machine comprising a grinding wheel which is supported by a column on a bed, a work table which is rotatably supported on the bed and which carries thereon at least one workpiece to be ground, said work table having an annular groove on its periphery, a fluid passage holder which is located in said annular groove to define a fluid space surrounding the fluid passage holder in said annular groove and which has a plurality of fluid pressure pockets opening into the fluid space, said fluid pressure pockets being connected to a fluid pressure source, said work table being inclined with respect to the grinding wheel when the pressurized fluid is selectively fed to said pressure pockets in a predetermined direction, valves for controlling the pressurized fluid to be fed to the fluid pressure pockets, and a control unit for controlling the operation of the valves.

* * * * *